United States Patent [19]

Plasko

[11] 4,075,596

[45] Feb. 21, 1978

[54] SEALED CASING FOR A THERMALLY ACTUABLE ELECTRICAL SWITCH

[75] Inventor: Emil Robert Plasko, Washington Township, Montgomery County, Ohio

[73] Assignee: Emerson Electric Co., St. Louis, Mo.

[21] Appl. No.: 716,806

[22] Filed: Aug. 23, 1976

[51] Int. Cl.[2] ..... H01H 37/76

[52] U.S. Cl. ..... 337/408; 337/414

[58] Field of Search ..... 337/407, 408, 409, 414, 337/415

[56] References Cited

U.S. PATENT DOCUMENTS

| | | | |
|---|---|---|---|
| 3,727,164 | 4/1973 | Cartier et al. | 337/409 X |
| 3,781,737 | 12/1973 | Henry | 337/407 |
| 3,930,215 | 12/1975 | Senor | 337/409 |
| 3,944,960 | 3/1976 | Audette et al. | 337/408 |

*Primary Examiner*—George Harris

*Attorney, Agent, or Firm*—Candor, Candor & Tassone

[57] ABSTRACT

A thermally actuatable electrical switch construction having a conductive open ended casing receiving an insulating sleeve in the open end thereof and a lead carrying insulating end plug disposed within the sleeve to close the open end of the casing. A sealing compound seals the casing to the sleeve external to the sleeve and the casing, the sealing compound also sealing the sleeve to the lead external to the sleeve and the lead.

5 Claims, 3 Drawing Figures

SEALED CASING FOR A THERMALLY ACTUABLE ELECTRICAL SWITCH

This invention relates to an improved thermally actuatable electrical switch construction and to the method of making the same.

It is well known, from the U.S. Pat. No. 3,944,960, to Audette et al, to provide a thermally actuatable electrical switch construction having a conductive open ended casing receiving an insulating sleeve in the open end thereof and a lead carrying insulating end plug disposed within the sleeve to close the open end of the casing, a sealing compound being disposed within the sleeve to seal the sleeve to the lead as well as to the insulating end plug.

However, it is believed acoording to the teachings of this invention, that air and/or moisture might seep from the exterior of the thermally actuatable electrical switch construction by capillary attraction between the insulating sleeve and the casing to the interior thereof and cause an adverse effect on the electrical switching means contained within the casing. For example, such a thermally actuatable electrical switch construction normally has a solid temperature sensitive pellet that holds the electrical switching means in one condition thereof as long as the pellet remains solid by being below a predetermined temperature. However, when such pellet reaches a predetermined temperature, the same rapidly changes from the normal solid condition thereof to a liquid condition and thereby permits the electrical switching means of the electrical switch construction to change to another condition thereof. Thus, it is desirable that the pellet material not be subjected to changing atmospheric air and/or moisture conditions because over a certain period of time, such changing conditions might have a tendency to break down the pellet material and cause the electrical switch construction to malfunction.

Accordingly, it is a feature of this invention to provide improved sealing of the open end of the casing of the aforementioned thermally actuatable electrical switch construction and the like.

In particular, one embodiment of this invention comprises a thermally actuatable electrical switch construction of the above type wherein a sealing means is utilized to seal the casing to the sleeve external to the sleeve and the casing. Such sealing means can be the same sealing means that is utilized to seal the sleeve to the lead external to the sleeve and the lead, if desired.

Accordingly, it is an object of this invention to provide an improved thermally actuatable electrical switch construction having one or more of the novel features set forth above or hereinafter shown or described.

Another object of this invention is to provide a method of making such a thermally actuatable electrical switch construction, the method of this invention having one or more of the novel features set forth above or hereinafter shown or described.

Other objects, uses and advantages of this invention are apparent from a reading of this description which proceeds with reference to the accompanying drawings forming a part thereof and wherein.

Figure 1:
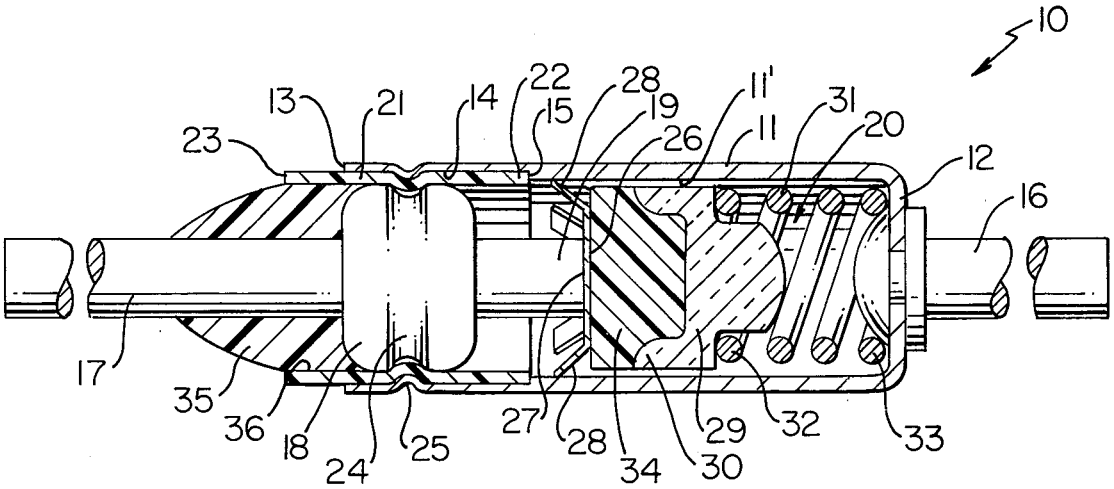
FIG. 1 PRIOR ART
FIG. 1 is a cross-sectional view of a prior art thermally actuatable electrical switch construction.

While the various features of this invention are hereinafter described and illustrated as being particularly adapted to provide sealing means for the thermally actuatable electrical switch construction of the U.S. Pat. No. 3,944,960, to Audette et al, it is to be understood that the various features of this invention can be utilized singly or in any combination thereof to provide sealing means for other types of electrical switch constructions, as desired.

Therefore, this invention is not to be limited to only the embodiments illustrated in the drawings, because the drawings are merely utilized to illustrate one of a wide variety of uses of this invention.

Figure 2:
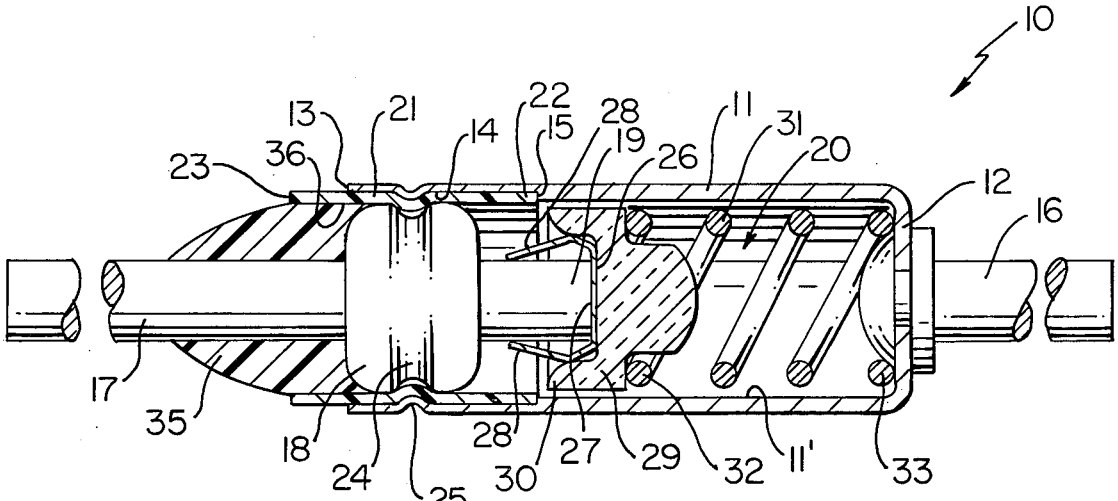
FIG. 2 PRIOR ART
FIG. 2 is a view similar to FIG. 1 and illustrates the prior art thermally actuatable electrical switch construction after the same has been thermally actuated.

Referring now to FIGS. 1 and 2, the prior art thermally actuatable switch construction of the aforementioned U.S. Pat. No. 3,944,960, to Audette et al, is generally indicated by the reference numeral 10 and since reference can be made to the patent to Audette et al for any necessary description of the parts and the operation thereof, it is deemed only necessary to generally describe the thermally actuatable electrical switch construction 10 in this application in order to fully understand the features of this invention.

Accordingly, it can be seen that the thermally actuatable electrical switch construction 10 comprises an open ended conductive casing 11 having a closed end 12 and an open end 13 that is counter-bored at 14 to define an internal shoulder 15 for a purpose hereinafter described.

A conductive lead 16 is suitable secured to the closed end 12 of the casing 11 and an opposed lead 17 is disposed in a press-fit manner through a suitable opening (not shown) in an insulating end plug 18 that is adapted to be disposed in the open end 13 of the casing 11 to insulatively support and hold an inner end 19 of the lead 17 within an interior chamber 20 of the casing 11 for a purpose hereinafter described.

However, an insulating sleeve 21 formed of a flexible electrical insulating material, such as may be formed from a polyimide resin available commercially from E. I. DuPont de Nemours & Company under the trademark KAPTON, is disposed in the open end 13 of the casing 11 and has its inner end 22 abutted against the shoulder 15 to position the sleeve 21 so that its outer end 23 projects beyond the open end 13 of the casing 11 as illustrated in FIGS. 1 and 2.

The end plug 18 has an annular groove 24 formed therein so that after the sleeve 21 and end plug 18 have been disposed in the open end 13 of the casing 11 as illustrated in FIG. 1, the casing 11 can be inwardly crimped or rolled to form an annular groove 25 therein to tend to force the casing 11 and insulating sleeve 21 into the annular groove 24 of the end plug 18 to thereby hold the sleeve 21 and end plug 18 in the desired position illustrated in FIGS. 1 and 2.

A contact member 26 has a central part 27 disposed against the end 19 of the lead 17 and is provided with a plurality of outwardly directed spring fingers 28 which normally tend to be biased radially outwardly of the center portion 27 thereof so that the same are maintained into positive electrical contact with the interior surface 11' of the conductive casing 11 whereby an electrical circuit is provided from the lead 16, casing 11, spring fingers 28 and, thus, conductor member 26 to the lead 17.

In this manner the electrical switch construction 10 can be disposed in a suitable electrical line to pass electrical current therethrough as long as the thermally actuatable electrical switch construction 10 is sensing a temperature below a predetermined temperature. However, when the switch construction 10 is sensing a temperature above the predetermined temperature, the same causes the fingers 28 of the conductor member 26 to be deformed away from the interior surface 11' of the casing 11 in the manner illustrated in FIG. 2 so that the electrical circuit between the leads 16 and 17 is broken and cannot be remade until a new thermally actuatable switch construction 10 is disposed in place of the tripped switch construction 10 of FIG. 2.

The means for deforming the spring fingers 28 of the conductor member 26 from the condition of FIG. 1 to the condition of FIG. 2 comprises a cup-shaped member 29 of insulating material having its open end 30 facing toward the conductor member 26 and normally being urged toward the same by a compression spring 31 disposed within the chamber 20 of the casing 11 and having one end 32 bearing against the cup-shaped member 29 and the other end 33 bearing against the end wall 12 of the casing 11. A temperature sensitive pellet member 34 is disposed between the cup-shaped member 29 and the conductive member 26 as illustrated in FIG. 1 and as long as the same remains in the solid condition illustrated in FIG. 1, the pellet member 34 holds the cup-shaped member 29 away from the conductive member 26 so that the spring fingers 28 of the conductive member 26 will remain in spring biased electrical contact with the interior surface 11' of the casing 11.

However, when the temperature sensitive member 34 senses a predetermined temperature, the same collapses by changing from the normal solid state thereof to the liquid state in the manner illustrated in FIG. 2 so that the force of the compression spring 30 will rapidly drive the cup-shaped member 29 to the left and the open end 30 thereof will cam and deform the spring fingers 28 downwardly away from the interior surface 11' of the casing 11 to thereby break the electrical circuit between the aforementioned U.S. patent to Audette el al.

In order to seal the end plug 18 for the lead 17 in the open end 13 of the casing 11, a potting compound 35 is disposed within the open end 23 of the sleeve 21 to engage against the interior surface 36 of the sleeve 21 and the end plug 24 and thereby seal the sleeve 21 not only to the end plug 24, but also to seal the sleeve 21 to the lead 17 and down a desired length thereof as illustrated in FIG. 1.

As previously stated, it is a feature of this invention to provide a further sealing of the open end 13 of the casing 11 of the switch construction 10 previously described because it is believed that in the switch construction 10 illustrated in FIGS. 1 and 2, air and/or moisture might tend to seep by capillary action between the casing 11 and the sleeve 21 down the counter-bore 14 and shoulder 15 into the chamber 20 to not only cause deterioration of the pellet material 34, but also cause damage to the other parts of the electrical switch construction 10 that might cause the switch construction 10 to malfunction.

Therefore, it is believed, according to the teachings of this invention, that the same sealing compound 35 being utilized in the aforementioned U.S. patent to Audette el al to seal the sleeve 21 to the lead 17 and end plug 18, can also be utilized to seal the casing 11 to the sleeve 21 external of the casing 11 and sleeve 21 to prevent air and moisture from seeping between the sleeve 21 and casing 11.

Figure 3:
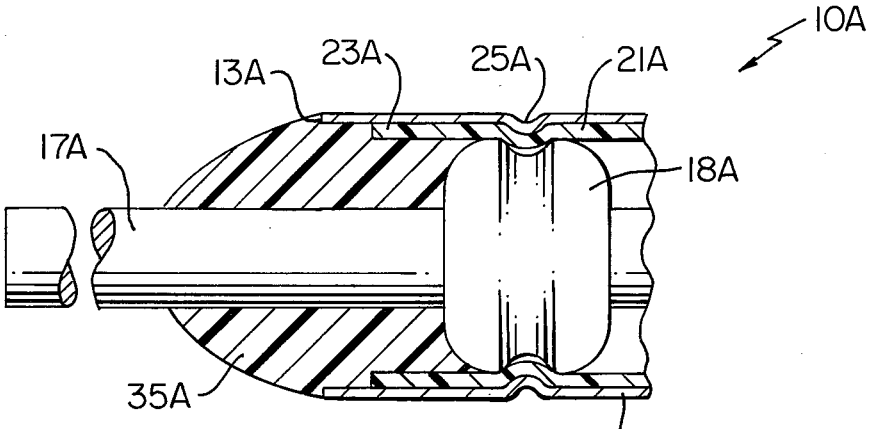
FIG. 3 is an enlarged fragmentary view similar to FIGS. 1 and 2 and illustrates the improved sealing means of this invention.

Accordingly, the thermally actuatable electrical switch construction of this invention having the above described sealing means is generally indicated by the reference numeral 10A in FIG. 3 and parts thereof similar to thermally actuatable switch construction 10 previously described are indicated by like reference numerals followed by the reference letter "A".

As illustrated in FIG. 3, the lead carrying insulating end plug 18A, insulating sleeve 21A, and casing 11A are fastened together by the annular groove 25A in the casing 11A for the reasons previously set forth so that the lead 17A will be supported in an insulating manner in the open end 23A of the casing 11A for the purpose previously described.

However, in the thermally actuatable switch construction 10A of this invention, the sleeve 21A is so disposed that the left-hand end 23A thereof is inboard of the open end 13A of the casing 11A whereby when the sealing compound 35A, such as an epoxy resin or the aforementioned potting compound, is utilized to close the open end 23A of the sleeve 21A, the same also fills the open end 13A of the casing 11A to extend from that open end 13A down the left-hand part of the lead 17A to the desired distance. In this manner, the compound 35A not only seals the sleeve 23A to the lead 17A, but also the compound 35A seals the casing 11A to the sleeve 23A and to the lead 17A so that no air or moisture external of the switch construction 10A can seep between the casing 11A and the sleeve 21A as might be the case in the switch construction 10 of FIGS. 1 and 2.

Thus, it can be seen that by disposing the open end 13A of the casing 11A beyond the end 23A of the sleeve 21A, it is relatively easy to cause the compound 35A to completely seal not only the open end 23A of the sleeve 21A, but also the open end 13A of the casing 11A for the dual purpose of sealing the sleeve 21A to the lead 17A and the casing 11A to the sleeve 21A for the reasons previously set forth, the compound 35A also sealing the sleeve 21A to the insulating end plug 18A as before.

It is obvious that the operation of the electrical switch construction 10A of this invention is identical to the operation of the prior art thermally actuatable switch construction 10 of FIGS. 1 and 2 previously described whereby it is deemed unnecessary to specifically describe the operation of the electrical switch construction 10A of this invention.

If desired, the electrical switch construction 10A of this invention could have the sleeve 21A precrimped into the annular groove of the end plug 18A so that the lead 17A, and plug 18A and sleeve 21A would provide a sub-assembly that could be inserted as a unit into the open end 13A of the casing 11A and could be subsequently fastened therein by the end 13A of the casing 11A being turned over the end 23A of the sleeve 21A so that the annular groove 25A in the casing 11A could be eliminated and the turned over end 13A of the casing 11A would secure the sub-assembly of the lead 17A, end plug 18A and sleeve 21A in position to be subsequently sealed by the sealing compound 35A in the manner previously described.

Accordingly, it can be seen that this invention not only provides an improved thermally actuatable electrical switch construction, but also this invention provides an improved method of making such a thermally actuatable switch construction.

While the form and method of this invention now preferred have been described and illustrated as required by the Patent Statute, it is to be understood that other forms and method steps can be utilized and still fall within the scope of the appended claims.

What is claimed is:

1. In a thermally actuatable electrical switch construction having a conductive open ended casing receiving an insulating sleeve in the open end thereof and a lead carrying insulating end plug disposed within said sleeve to close said open end, the improvement wherein said sleeve is disposed completely within said casing and inboard of the open end of said casing, and comprising a sealing means sealing said casing to said sleeve external to said sleeve and said casing.

2. A switch construction as set forth in claim 1 and including a sealing means sealing said sleeve to said lead external to said sleeve and said lead.

3. A switch construction as set forth in claim 2 wherein said sealing means for said sleeve and casing and said sealing means for said sleeve and lead comprises the same sealing means.

4. A switch construction as set forth in claim 3 wherein said sealing means comprises a plastic-like material disposed on said construction from said open end of said casing to said lead to completely seal said open end of said casing from said casing to said lead that projects out of the same.

5. A switch construction as set forth in claim 5 wherein said sealing means also seals said end plug to said sleeve and to said lead.

* * * * *